US005383973A

United States Patent [19]

Curry, Jr.

[11] Patent Number: 5,383,973

[45] Date of Patent: Jan. 24, 1995

[54] METHOD FOR CLEANING HEATING, VENTILATING AND AIR CONDITIONING DUCTS

[75] Inventor: Ward E. Curry, Jr., Venice, Fla.

[73] Assignee: ADCS/Air Duct Cleaning Systems, Inc., Venice, Fla.

[21] Appl. No.: 139,986

[22] Filed: Oct. 21, 1993

[51] Int. Cl.[6] ..... B08B 7/00; B08B 5/00; B08B 6/00; B08B 9/00

[52] U.S. Cl. ..... 134/8; 134/6; 134/7; 134/22.1; 134/22.12; 134/22.18; 134/37

[58] Field of Search ..... 134/8, 6, 7, 22.1, 22.12, 134/22.18, 37

[56] References Cited

U.S. PATENT DOCUMENTS 3,485,671 12/1969 Stephens ..... 134/7
4,132,567 1/1979 Blackwood ..... 134/1
4,895,602 1/1990 Sagawa ..... 134/7
5,086,833 2/1992 Ben-Dosa ..... 165/95
5,176,204 1/1993 Ben-Dosa ..... 165/95

*Primary Examiner*—Richard O. Dean
*Assistant Examiner*—Zeinab El-Arini
*Attorney, Agent, or Firm*—Pettis & McDonald

[57] ABSTRACT

A method for removal of undesirable foreign matter from the interior of existing duct systems. The method comprises the insertion of a plurality of members into a stream of air within the existing duct to loosen the dirt adhering to the duct walls. The members are capable of receiving and holding a static electric charge on their exterior surfaces so that when the members are agitated within the stream of air and against the duct, a static electrical charge is placed thereon. The electrical charge causes a portion of the foreign matter to be attracted to and adhere to the members. The stream of air with the members and loose foreign matter entrained therein is then removed from the duct.

8 Claims, 3 Drawing Sheets

METHOD FOR CLEANING HEATING, VENTILATING AND AIR CONDITIONING DUCTS

BACKGROUND OF INVENTION

1. Field of the Invention

The present invention relates to a method for removal of undesirable foreign matter from the interior of existing duct systems. More specifically, the method comprises the insertion of a plurality of members with a static electrical charge thereon into a stream of air passing through a duct to remove the foreign matter without damage to the duct system.

2. Description of the Prior Art

The primary method for cleaning heating, ventilating and air conditioning ("HVAC") duct systems located within structures has been to insert vacuum cleaner wands and hoses through access ports into the ducts for the direct removal of undesirable foreign matter that has collected within the duct or has adhered to the duct surfaces. To be effective this method requires that numerous access ports be made in the ducts as the vacuum cleaner pipes and hoses extend for short distances and are unable to reach around corners in the duct. As ducts normally are located above the ceiling of the structure, numerous unsightly access panels are required in the ceiling to gain access to the access ports in the ducts. This method of cleaning is slow and laborious requiring access to many access ports. Furnishings must be moved in order to open the access ports and control of the loose foreign matter is difficult.

An improved method for cleaning ducts is disclosed by U.S. Pat. No. 3,485,671 issued to Stephen. This method utilizes a cleaning material of walnut shells ground to a consistency of course sand or felt, foam, plastic and other materials of various shape and sizes that are inserted within the duct system and moved by a stream of air that is passed through the duct system from the insertion point to an outlet point where the cleaning material and foreign matter is collected. However, the fine cleaning material and the fine dust particles are difficult to trap and often escape into the interior of the structure. Also, the smaller particles require a large device to capture and separate the cleaning material from the foreign matter. Cleaning materials that are small or finely ground may be carried by the stream of air into the filter system, prematurely clogging the filters.

Therefore, there is a need to capture the finer dust so that it may be removed from the air in the duct and kept from escaping into the facility. There is also a need for a simple portable system using a cleaning material that is easily separable from the air stream.

SUMMARY OF THE INVENTION

The present invention relates to a method for removal of undesirable foreign matter from the interior of ducts, including but not limited to heating, ventilating and air conditioning (HVAC) ducts. The method comprises the steps of selecting a duct having undesirable foreign matter collected therein or adhering to the duct walls and providing a stream of air within that duct. The method further comprises inserting a plurality of members, which have an exterior surface that is capable of receiving and holding a static electric charge, through an access port into the duct. The members are agitated within the air stream and against the duct for placement of a static electric charge on the surface of the members. The stream of air is moved through a predetermined length of duct that is to be cleaned so that a portion of the foreign matter is attracted to and carried by the members and a portion is carried by the stream of air. The air and the members are then removed from the duct along with a portion of the foreign matter that had been lodged within the duct.

The invention accordingly comprises the several steps and the relation of one or more of such steps with respect to each of the others thereof, which will be exemplified in the method hereinafter disclosed, and the scope of the invention will be indicated in the claims.

BRIEF DESCRIPTION OF THE DRAWINGS

For a fuller understanding of the nature and the objects of the invention, reference should be had to the following detailed description taken in connection with the accompanying drawings in which.

DESCRIPTION OF THE PREFERRED EMBODIMENT

Figure 1:
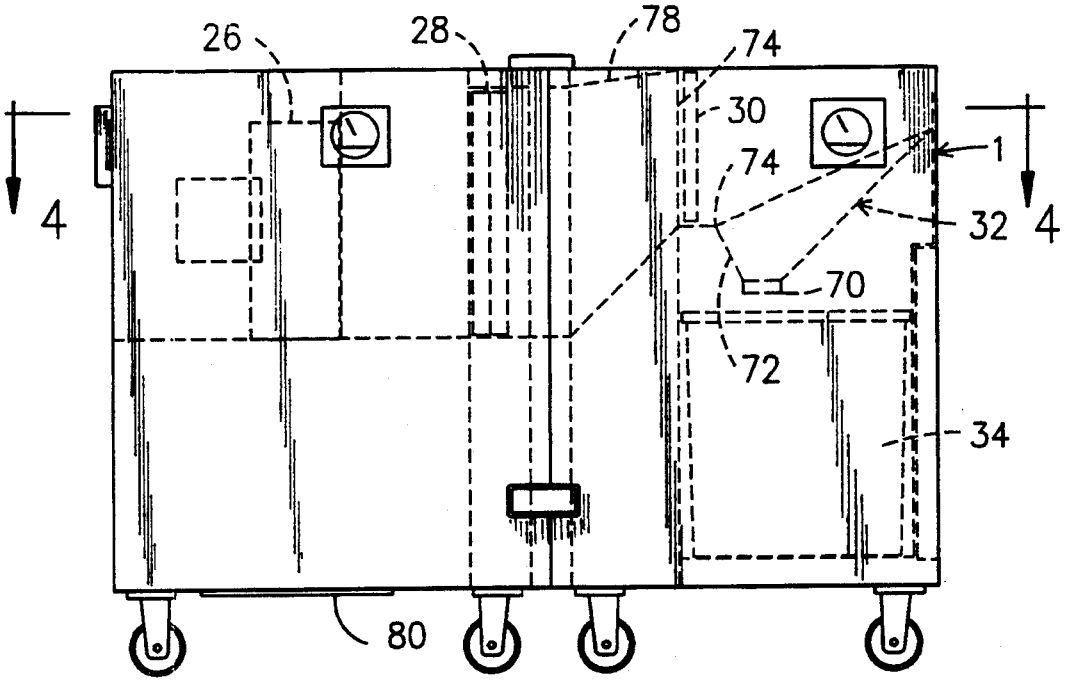
FIG. 1 is a front elevational view of an apparatus that is useful in practicing the method of this invention.
Figure 2:
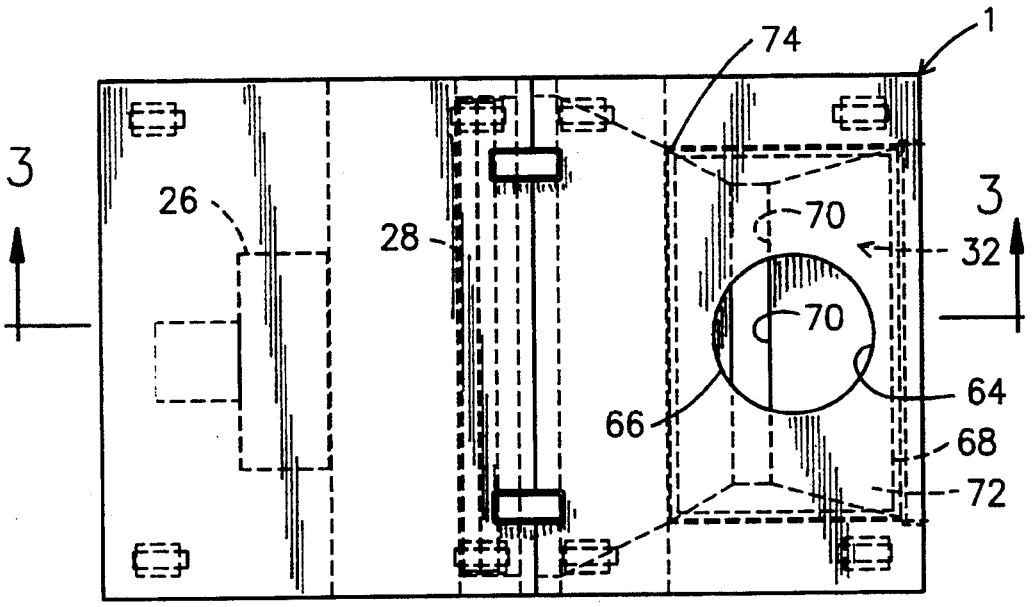
FIG. 2 is a plan view of the apparatus of FIG. 1.
Figure 3:
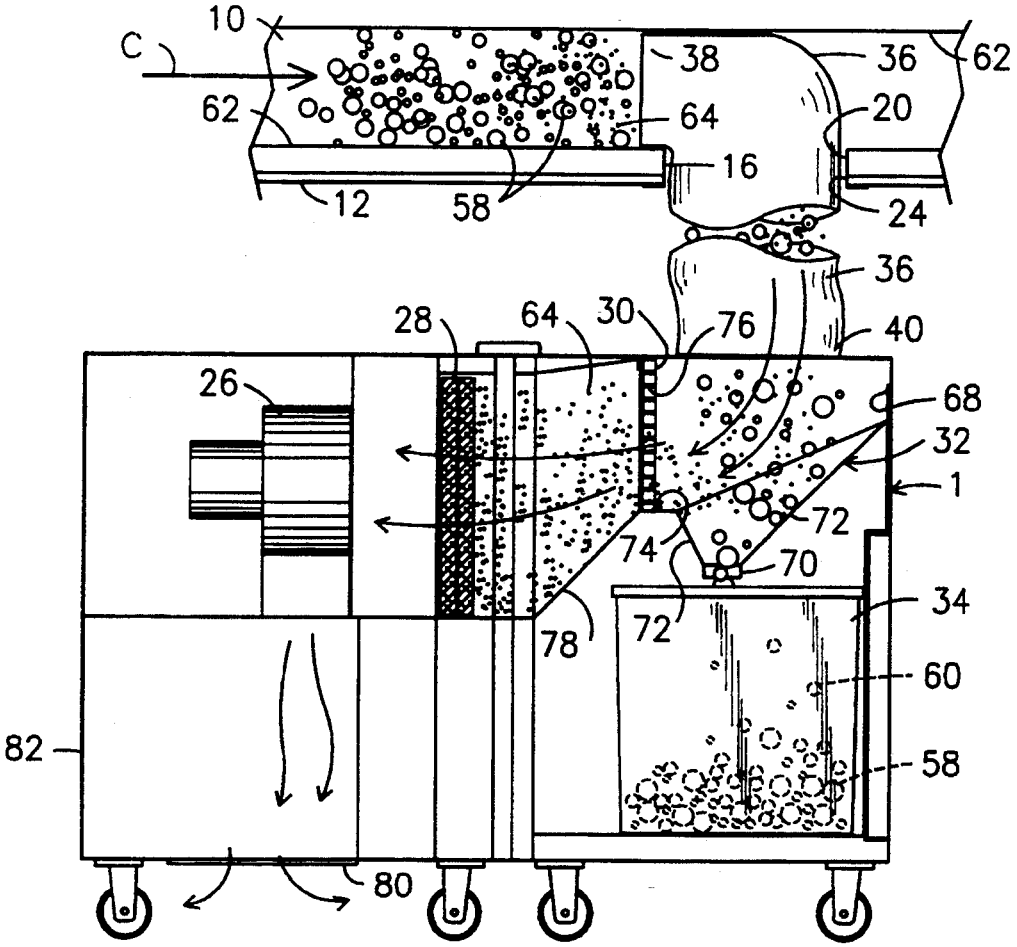
FIG. 3 is a cross-sectional view of the apparatus taken along line 3—3 of FIG. 2, illustrating the apparatus connected to a duct and illustrating the movement of the members and the foreign matter within the duct and the apparatus.
Figure 4:
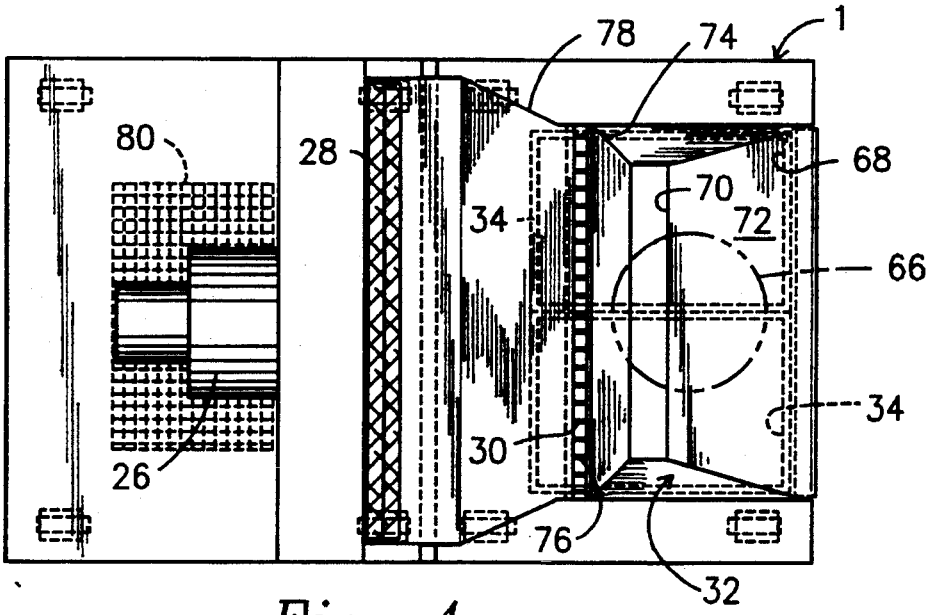
FIG. 4 is a cross-sectional view of the apparatus of FIG. 1 taken along line 4—4.
Figure 5:
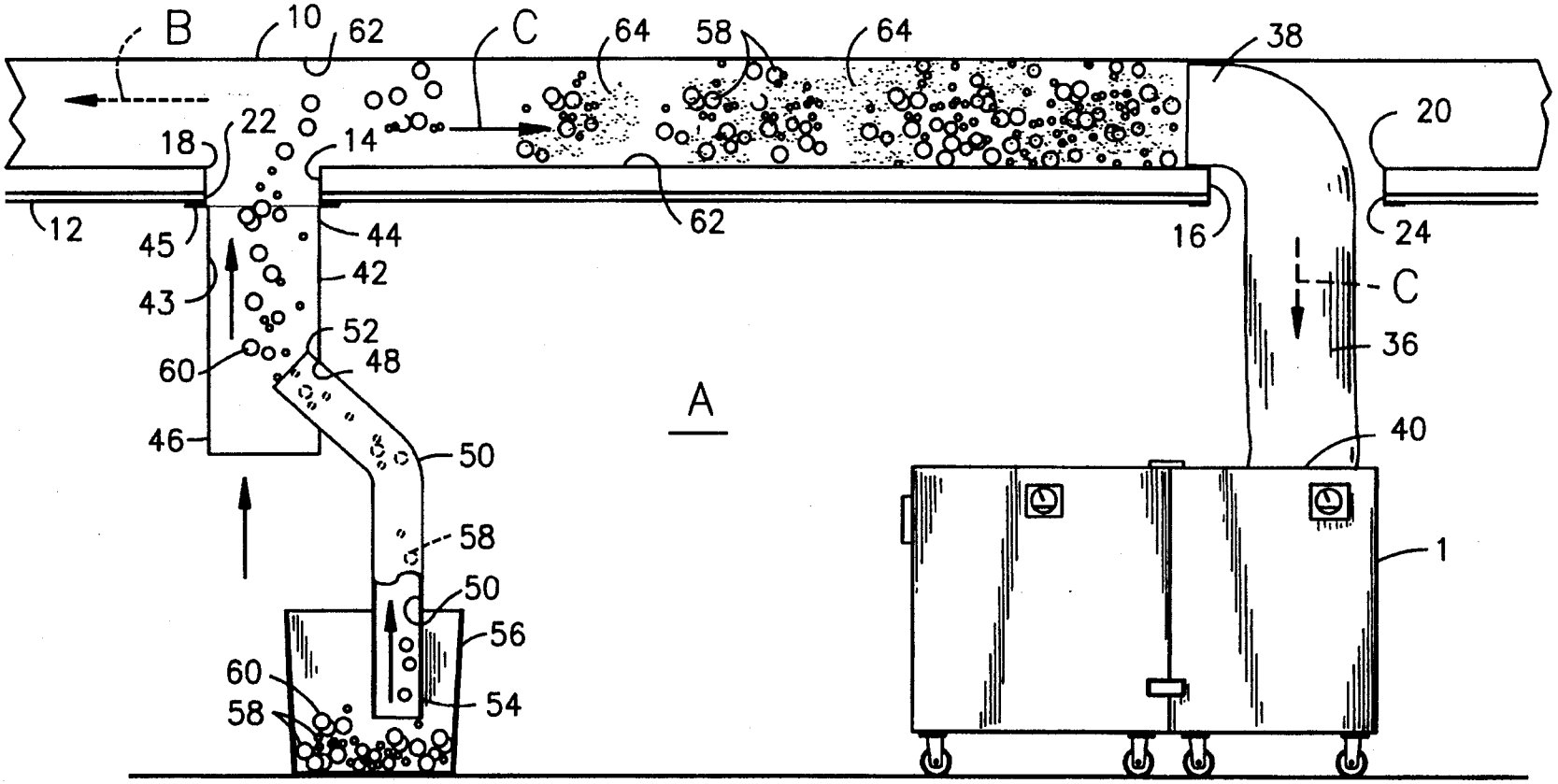
FIG. 5 is a side elevational view of the apparatus of FIG. 1 connected to a duct illustrating the method of insertion of the members.

FIGS. 1-5 illustrate an apparatus that is suitably adapted for the practice of the method of this invention. The duct 10 shown in FIGS. 3 and 5 may be a portion of a typical air supply system that is utilized for the heating, ventilating and air conditioning of the interior A of a facility. The operating fluid in a typical air supply system is usually treated air. As duct systems are usually installed above the ceiling of a structure, a preferred embodiment of the apparatus, as illustrated in FIGS. 3 and 5, is illustrated in relation to a portion of a duct 10 located above a ceiling 12. To provide treated air into the interior A of the structure, duct systems provide supply ducts, illustrated as supply ducts 14 and 16, that are connected in fluid flow communication between openings 18 and 20 respectively, in the duct 10 and the interior A. Supply duct 14 passes through aperture 22 in the ceiling and supply duct 16 passes through aperture 24. During normal operation of the air handling system (not shown) the air supplied to the duct 10 moves in the direction B.

The apparatus 1 comprises a means for providing a stream of air (conveniently a fan unit 26), a filter unit 28, a separator grid 30, a collector 32, and at least one bin 34. A flexible outlet conduit 36 has a first end 38 that is insertable through supply duct 16 into the duct 10. The second end 40 of the outlet conduit 10 is attached by conventional means in fluid flow communication with the apparatus 1.

An inlet conduit 42, having an interior surface 43 and a first end 44, is placed in fluid flow communication with supply duct 14 so that the first end 44 of the inlet conduit 42 is generally sealed against ceiling 12 so that air may move freely through the inlet conduit 42, through the supply duct 14 and into duct 10. The inlet conduit 42 has a hole 48 therethrough proximal to its second end 46. A tube 50 having an interior surface 51, a first end 52 and a second end 54 is formed so that the first end 52 may project through the hole 48 in the inlet conduit 42 and the second end 54 may project into a container 56. The apparatus 1 and its related outlet conduit 36, inlet conduit 42, tube 50 and container 56 comprises but one apparatus that may be adapted to implement the method of this invention.

For illustration purposes, a portion of duct 10 is selected for cleaning between supply ducts 14 and 16 as shown in FIG. 5. The apparatus 1, the outlet conduit 36, the inlet conduit 42, the tube 50, and the container 56 are arranged as shown in FIG. 5 and as previously described. The fan unit 26 is arranged to provide a stream of air within the duct 10 so that the movement of the air is toward the fan unit 26 in the direction C. In a preferred embodiment, the movement of the air by fan unit 26 in the direction C is in opposition to the normal direction B of flow of the air created by the HVAC air handling unit (not shown) when the HVAC system is operating. In other embodiments, particularly when cleaning the return air portion of an HVAC system, the direction C of the flow of the air created by fan unit 26 may be in the same direction as the normal direction B of the air flow created by the HVAC system. The preferred speed of flow of the air stream within the duct 10 by fan unit 26 is an average of 3000 linear feet per minute. Fan unit 26 may be sized in accordance with the average sizes of duct systems (the number of linear feet of duct and the cross section of the duct) expected to be cleaned by the particular model of apparatus 1. For example, to create an air stream traveling at approximately 3000 linear ft/min in a duct system supporting a 3 ton HVAC system, fan unit 26 would be a 3300 CFM at 1" static pressure unit. In larger systems the rate of air flow may drop below the optimum; however, by closing some of the registers in the system the rate of air flow may be increased toward the optimum air flow rate. In smaller HVAC systems the rate of flow would exceed the preferred rate increasing the suction applied to the HVAC system and thus increasing the cleaning force; however, care must be taken to ensure that the increased rate of flow does not damage the duct system. Of course, during the cleaning operation the HVAC air handling unit is shut off to prevent the HVAC equipment from working in opposition to the apparatus 1.

A plurality of members 58 are provided that have an exterior surface 60 capable of receiving and holding a static electrical charge. The members 58 are generally spherical and are formed from styrofoam with a roughened exterior surface 60. However, other materials that are capable of receiving and holding a static electrical charge may be suitable for the purpose if they are similar in weight to styrofoam and have a roughened surface for abrading the interior surfaces 62 of the duct 10. The members 58 must be sufficiently light for movement within the duct and sufficiently strong to prevent excessive breakup. In a preferred embodiment, at least two groups of members are placed into the stream of air with the members of each group having a different diameter. Using members 58 of different sizes improves the mobility of the members 58 through the duct 10, decreasing the opportunities for jamming. Also, smaller members 58 can reach smaller areas within the duct 10, including corner areas, for cleaning.

In a preferred embodiment, the members 58 are placed within the container 56 below the outlet 14. The inlet conduit 42 must be open, with the register, filters or other obstructions (not shown removed enabling access to the duct 10. With the inlet conduit 42 and the tube 50 in place as described previously, an area of reduced pressure is created by the movement of the air within the duct 10 pulling the members 58 into the tube 50, through the inlet conduit 42, through the supply duct 14 and into the duct 10. The members 58 are thus placed into the stream of air within tube 50 and the inlet conduit 42 for agitation by the stream of air and agitation against the interior surface 51 of the tube 50 and the interior surface 43 of the inlet conduit 42. The agitation of members 58 by the stream of air and the agitation of the members 58 against the interior surface 51 of the tube 50 and the interior surface 43 of the inlet conduit 42 creates a static electrical charge on the exterior surface 60 of the members 58 prior to the members being inserted within the duct 10. In other embodiments, the members 58 may be inserted directly into the duct 10 through supply duct 14 so that an electrostatic charge is developed on the exterior surface 60 of the members 58 by agitation within the stream of air in duct 10 and by agitation against the interior surface 62 of duct 10.

A portion of the undesirable foreign matter usually adheres to the interior surface 62 of the duct 10. The agitation of the members 58 against the interior surface 62 loosens the adhered foreign matter 64 placing it within the stream of air. The finer particles of foreign matter 64 are attracted to and captured on the exterior surface 60 of the members 58 by the static electrical charge created thereon. The collection of the finer dust particles onto the members 58 assists in their removal from the duct 10 and reduces leakage of the finer particles to points outside the removal system.

As shown most clearly in FIG. 3, the members 58 are collected by the first end 38 of the outlet conduit 36 and pass through the input port 64 (shown in FIG. 2) of the apparatus 1. The air stream, carrying the members 58, and carrying a portion of the foreign matter entrained therein, passes into and through the collector 32. The collector 32 is a funnel shaped duct with an open top 68, a smaller open bottom 70 and side walls 72. A portion 74 of one side wall 72 is open for fluid flow communication between the collector 32 and the fan unit 26. A separator grid 30 having holes 76 therethrough that are smaller than the diameter of the smallest member 58 is placed over the open portion 74 of the side wall 72. As the air stream with the members 58 entrained therein enters the collector 32, the members 58 continue downwardly through the open bottom 70 into bin 34 where they are collected. The separator grid 30 prevents any of the members 58 from being carried into the fan unit 26. The air stream is drawn forward toward the fan unit 26 through the apparatus duct 78. A filter unit 28 extends across the apparatus duct 78 removing at least a portion of the foreign matter 64 from the stream of air. The stream of air then moves through the fan unit 26 and downwardly through register 80, which is located in the exterior wall 82 of apparatus 1, returning the air to the interior A of the structure.

The air fan unit 26 is a standard fan unit well known in the art. Filter unit 28 may be any well known filter system including electrostatic separators that are capable of removing fine particles of foreign matter from an air stream. The members 58 in a preferred embodiment are generally between 1½ inches and ½ inch in diameter;

however, other sizes may be used which would be determined by the size of the duct through which the members 58 must be moved. The remaining portion of the apparatus 1 may be constructed from aluminum, steel, plastic or any other material or combination of materials that is suitable for the purpose.

The apparatus 1 comprises but one apparatus that may be adapted to implement the method of this invention. Most broadly stated the method comprises the steps of selecting a portion of duct having foreign matter therein that is to be cleaned. In a preferred embodiment, a plurality of generally spherical members formed from styrofoam are selected from at least two groups of members where the members of each group have a diameter different from the members of any other group. The exterior surface of the styrofoam members is capable of receiving and holding a static electrical charge. A stream of air is provided within the tube, the inlet conduit and the duct and the members are inserted into the stream of air for agitation within the air stream and against the interior of the tube, the inlet conduit and the duct for placement of a static electric charge on the surface of the members. In a preferred embodiment, the stream of air is provided within the duct in a direction opposite the predetermined direction of the operating fluid when the operating fluid is flowing through the duct.

The stream of air is moved through the portion of the duct to be cleaned carrying the members therein so that at least a portion of the foreign matter in the duct is loosened from the duct walls by the members and the stream of air. A portion of the loose foreign matter is attracted to and carried by the members and a portion is carried within the stream of air. The stream of air and the members are removed from the duct carrying a portion of the foreign matter from the duct. The members are then removed from the stream of air carrying a portion of the foreign matter with them. At least a portion of the foreign mater is then removed from the stream of air.

It will thus be seen that the objects set forth above, among those made apparent from the preceding description, are efficiently attained, and since certain changes may be made in carrying out the above method without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language may be said to fall there between.

Now that the invention has been described,

What is claimed is:

1. A method for removal of foreign matter from the interior of ducts adapted for movement of an operating fluid therethrough in one direction, said method comprising the steps of:

a. selecting at least a portion of a duct having an interior with foreign matter therein and said duct having an interior surface;

b. providing a stream of air within said portion of said duct;

c. providing a plurality of members having an exterior surface for receiving and holding a static electrical charge thereon;

d. placing said members into said stream of air for agitation by said stream of air and agitation against said interior surface of said duct thereby creating a static electric charge on said exterior surface of said members;

e. moving said stream of air and said members carried therein through at least said portion of said duct such that a portion of said foreign matter therein is attracted to and carried by said members and a portion is carried by said stream of air; and f. removing said members and said stream of air from said duct, whereby a portion of said foreign matter is removed from said duct.

2. The method of claim 1 comprising the additional step of removing said members with a portion of said foreign matter thereon from said stream of air.

3. The method of claim 1 comprising the additional step of removing at least a portion of said foreign matter from said stream of air.

4. The method of claim 1 comprising the additional step of providing an inlet conduit connected in fluid flow relation with said interior of said duct, providing a stream of air within said inlet conduit, said inlet conduit having an interior surface, agitating said members within said stream of air within said inlet conduit and against said interior surface of said inlet conduit for placement of a static electric charge on said surface of said members before said members enter said duct.

5. The method of claim 1 wherein at least a portion of said members provided are generally spherical.

6. The method of claim 5 wherein at least two groups of members are placed into said stream of air, said members in each of said groups having a different diameter.

7. The method of claim 1 wherein at least a portion of said members are formed from styrofoam.

8. The method of claim 1 wherein said stream of air is provided within said duct in a direction opposite to said one direction of said operating fluid when said operating fluid is flowing through said duct.

* * * * *